US006203141B1

(12) United States Patent
Wakahara et al.

(10) Patent No.: US 6,203,141 B1
(45) Date of Patent: Mar. 20, 2001

(54) IMAGE FORMING APPARATUS HAVING A CONTROL ELECTRODE SUPPORT STRUCTURE FOR FINE ADJUSTMENT OF THE CONTROL ELECTRODE IN A REGION OF THE GATES

(75) Inventors: Shirou Wakahara, Chiba; Tomohiko Okada, Soraku-gun, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/105,677

(22) Filed: Jun. 26, 1998

(30) Foreign Application Priority Data

Jun. 27, 1997 (JP) ..... 9-170823

(51) Int. Cl.[7] ..... B41J 2/86
(52) U.S. Cl. ..... 347/55
(58) Field of Search ..... 347/55, 141, 120, 347/111, 123, 159, 128, 17, 103, 154, 151, 327, 71, 352; 399/290, 291, 292, 293, 294, 295, 271

(56) References Cited

U.S. PATENT DOCUMENTS 5,293,181 3/1994 Iwao et al. .
5,640,185 6/1997 Kagayama ..... 347/55
5,850,244 * 12/1998 Leonard et al. ..... 347/141

FOREIGN PATENT DOCUMENTS 0 587 366 A1 3/1994 (EP) .
0 712 056 A1 5/1996 (EP) .
4-182151 6/1992 (JP) .

* cited by examiner

*Primary Examiner*—John Barlow
*Assistant Examiner*—Raquel Yvette Gordon
(74) *Attorney, Agent, or Firm*—Dike, Bronstein, Roberts & Cushman, LLP; David G. Conlin; George W. Neuner

(57) ABSTRACT

An image forming apparatus is described that records with the developer a desired image on a recording medium, which is transported in a transporting direction through a gap between a control electrode and a counter electrode, by supplying a potential to the control electrode based on image data and selectively permitting the developer to pass through gates. The control electrode is a flat-shaped member interposed between the developer carrier and the counter electrode. It has a pair of support regions that are spaced apart from a central region, one supporting region on each side of said central region in the transporting direction. A first support member has a first flat surface and a first fixing member that holds one support region of the control electrode member fixedly on said first flat surface and (2) a second support member has a second flat surface and a second fixing member that holds the other support region of the control electrode member fixedly on said second flat surface. An adjustment feature can be used for slightly deforming the supporting member in the transporting direction.

11 Claims, 11 Drawing Sheets

IMAGE FORMING APPARATUS HAVING A CONTROL ELECTRODE SUPPORT STRUCTURE FOR FINE ADJUSTMENT OF THE CONTROL ELECTRODE IN A REGION OF THE GATES

BACKGROUND OF THE INVENTION

1. Field of the Invention

The present invention relates to an image forming apparatus applicable to digital copiers, printer stations of facsimiles, digital printers, plotters and the like and more particularly, to an image forming apparatus adapted to directly form an image on a recording medium by projecting a developer thereto.

2. Description of the Related Art

As popular image forming methods of forming visible images on receiving media, such as sheet-like copy paper, based on electric signals supplied from computers, word processors, facsimiles and the like, there have generally been employed an ink jet system utilizing an ink, a heat transfer system transferring the visible image by fusing the ink, a system sublimating the ink and an electrophotographic system.

To cope with recent demands for a high speed image forming process and a high-quality image, there has been employed the electrophotographic system arranged such that a photoconductor is irradiated with light for forming a toner image thereon and the toner image is transferred to the recording medium such as a copy sheet. The image forming process includes the steps of converting an electric signal into light rays by way of a laser emitting device or an LED head; applying the light rays to the photoconductor preliminarily charged to a uniform potential thereby forming on the surface of the photoconductor an electrostatic latent image corresponding to intensities of the light rays; developing a toner image on the surface of the photoconductor by bringing toner into contact with or projecting the toner to the electrostatic latent image, the toner stored at a toner carrier; making the toner image electrically attracted to the recording medium; and subsequently applying both pressure and heat or either of them to the recording medium thereby to transfer the toner image to the recording medium. There exists a demand for a simplified structure of the electrophotographic image forming apparatus, which requires the photoconductor.

In this connection, there have been proposed image forming apparatuses which do not require the photoconductor and the like for forming an image on a recording member. For example, Japanese Unexamined Patent Publication JP-A 4-182151 (1992) has proposed an image forming apparatus which forms a toner image on a recording medium or a sheet in such a manner that the toner are charged by means of an electric field for electrically projecting the toner while a control electrode including a plurality of passage holes disposed in a toner-projection path is applied with a potential which is varied to make the toner attracted directly to the recording medium.

In image forming apparatuses represented by the apparatus disclosed in JP-A 4-182151 above-mentioned which is adapted to project the toner for forming an image directly on a copy sheet, the quality of a produced image greatly depends upon a construction of the control electrode, which controls the potential applied thereto thereby regulating a quantity of toner, as the developer, passing through the apertures thereof.

By maintaining constant distances between a control electrode member formed with the apertures and the control electrode, and a carrier carrying the toner thereon, and between the control electrode and a counter electrode, the toner projection is stabilized for recording images in favorable conditions. The prior-art control electrode member is small in thickness. That is, the control electrode member is formed of a flexible substrate which tends to be bent by an external force or other factors thus deteriorating the positional relations above-mentioned. This results in an unstable toner projection which adversely affects the quality of produced images.

Accordingly, the image forming apparatus disclosed in the patent publication above-mentioned utilizes a pair of bases fixed to places at opposite ends of the flexible substrate composing the control electrode member. Interposed between the bases is a spring for urging the bases in directions to increase a distance therebetween so that the control electrode may be held under a tension for prevention of the deformation of the control electrode member.

In the prior-art image forming apparatus such as disclosed in the patent publication, constant distances between the control electrode and the counter electrode and between the control electrode and the carrier are maintained by preventing the control electrode from being bent, whereby the toner projection is stabilized.

The control electrode member of the image forming apparatus is supported at a distance of about 100 $\mu$m, for example, from the carrier. In such a prior-art construction, if warpage and undulation on the order of dozens micrometers is produced in the control electrode member or the flexible substrate of which the control electrode member is formed, the control electrode member mounted to a predetermined position may be deformed due to the warpage and undulation of the substrate. The control electrode is formed with multitudes of apertures for the passage of the toner, close to which apertures the control electrodes are formed, respectively. The apertures thus formed reduce the strength of the control electrode member so that a region formed with the apertures or the control electrodes is more susceptible to the warpage and undulation. The value of several dozens micrometers is quite great relative to the distance of 100 $\mu$m. The dozens micrometers relative to 100 $\mu$m account for quite a great error. In this case, a desired control of the toner projection is not always achieved. For example, if the distance between the control electrode member and the toner carrier is increased by dozens micrometers, an insufficient amount of toners is projected to form dots of an insufficient size or density, and a degraded image results. This leads to not only difficulty in producing a desired halftone but also to impossibility of favorable color reproduction by the color image forming apparatus.

Conversely, where the control electrode member deformed due to the warpage and undulation thereof defines a reduced distance to the toner carrier, an excessive amount of toner is projected to form dots of an excessive size or density. Naturally, this also results in a degraded image. In addition, the production of halftone becomes difficult while the color reproduction by the color image forming apparatus is adversely affected.

The production of warpage and undulation in the control electrode is unavoidable because a thermal processing is indispensable for the production thereof. In order to eliminate the warpage and undulation, the technique disclosed in the patent publication utilizes the spring to apply a tension to the control electrode.

In the arrangement wherein the control electrode member is subjected to the tension for elimination of the warpage and undulation therein, quite a great tension is required. Accordingly, a fear exists that the member for supporting the control electrode member cannot withstand the tension to be broken, or that the control electrode member cannot withstand the tension to suffer further production of warpage and undulation or to end up with the breakage thereof.

SUMMARY OF THE INVENTION

In view of the foregoing, it is an object of the invention to provide a mounting device for the control electrode member, which device is of a simple construction and capable of eliminating the warpage and undulation produced in the control electrode member, thereby offering an image forming apparatus adapted to prevent the degradation of image quality.

As described in the foregoing, the prior-art mounting device is adapted to apply a great tension to the control electrode member for eliminating the warpage and undulation of the control electrode member. It is another object of the invention to provide an image forming apparatus utilizing simple means for effectively eliminating the warpage and undulation without resorting to such a great tension exerted on the control electrode member, thereby accomplishing a stable forming of images free from a trouble such as degradation of image quality.

For achieving the above-mentioned objects the present invention provides an image forming apparatus comprising:

a carrier for carrying thereon a developer charged at a predetermined polarity;

a counter electrode disposed to be opposed to the carrier; and a flat-shaped control electrode member interposed between the carrier and the counter electrode, having a plurality of gates for passage of the developer and control electrodes for controlling selective passage of the developer by means of the respective gates thereof, the image forming apparatus recording with the developer a desired image on a recording medium transported through a gap between the control electrode and the counter electrode by supplying a developer-passage potential to the control electrodes based on image data and thereby selectively permitting the developer to pass through the gates, wherein a pair of support regions of the control electrode deviated from a region of passage of the developer via the gate, toward both sides of the transporting direction, respectively, is fixed to flat portions of respective supporting members, respectively, the image forming apparatus further comprising a supporting device for supporting the supporting member to a support body retained at a predetermined position, wherein the supporting member is fixed to the support bodies in a state in which forces in directions to draw the support regions closer to each other are applied to the support regions so as to resiliently curve the control electrode member supported by the supporting devices at the region including the gates.

According to the invention, the control electrode member is supported in a manner to be curved particularly at the gate region thereof through which the developer, such as toner, is projected. The resultant curved portion of the control electrode member accommodates a warpage and undulation extending over a small area of the region F1 of the control electrode member, thus eliminating the warpage and undulation. This eliminates an influence of the warpage and undulation of the control electrode member exerted on the gate region for the passage of the toner so that the toner-projection is stabilized. As a result, there is accomplished the forming of favorable images free from degraded image qualities.

The control electrode member is, of course, curved to a degree such as to eliminate the warpage and undulation for stable toner-projection. If the curved portion is too deep, an effect of eliminating the warpage and undulation is increased but a distance between the control electrode member and the carrier along a direction perpendicular to the direction of transporting the recording medium is increased and a distance between the control electrode member and the counter electrode along a distance perpendicular to the direction of transporting the recording medium is increased. Hence, a lowered image quality results. Therefore, the control electrode member is supported as curved at a greatest possible curvature that permits the elimination of the warpage and undulation.

The image forming apparatus according to the invention is characterized in that the supporting device has a structure in which the support region of the control electrode member is fixed to position by holding between the flat portion of the supporting member and the fixing member having a flat-shaped portion.

In the image forming apparatus of the above construction, the supporting device has the structure such that the control electrode is fixed to position as held between the flat portions of the rigid supporting member and of the fixing member. By holding the control electrode member between these flat portions, the warpage and undulation extending over a small area of the region F1 of the control electrode member is eliminated. In addition, the pressure is wholly applied to the control electrode member rather than applied locally so that a partial breakage of the electrode member is avoided. The control electrode member is supported at a predetermined position by the use of a very simple construction utilizing the supporting member 51 and the fixing member 52 which have flat portions, respectively. Hence, the image forming apparatus of the invention accomplishes the reduction of costs and size as well as the improvement in reliability.

The image forming apparatus according to the invention is further characterized in that the supporting device fixes the supporting member to the support body at at least two points spaced from each other along a direction intersecting with the transporting direction, and that adjustment means for slightly deforming the supporting member in the direction of transporting the recording medium is provided at a place other than the fixing points of the supporting member.

In the image forming apparatus constructed as above, the supporting device is the arrangement such that the supporting member is fixed to the support body at least at two or more points while the adjustment means for slightly deforming the supporting member in the direction of transporting the recording paper is provided at a place different from the fixing points. By way of an example shown in FIG. 6, warpage and undulation extending over a wide area of the control electrode 26 produces a gap 'd'. For eliminating or reducing the gap 'd', the adjustment means 56 is utilized to produce a minute quantity (L) of deformation of the supporting member 51, as shown in FIG. 2, thereby to pull a central portion of the control electrode 26. The quantity of deformation is adjustable on the order of dozens micrometers for reducing or eliminating the gap 'd'.

The image forming apparatus according to the invention is further characterized in that the adjustment means includes a resilient urging member for applying a spring-urging force to the supporting member in the direction of transporting the recording paper thereby to slightly deform the supporting member.

The adjustment means is provided with the urging member for applying the urging force to the supporting member in the direction of transporting the recording paper thereby to slightly deform the supporting member. This provides a more effective elimination of the warpage and undulation of the control electrode. In addition, the urging member serves to relieve the force exerted on the supporting member so that the slight deformation of the supporting member is maintained for accommodation of locally produced warpage and undulation.

Furthermore, a resilient deformation of a bent portion of the support body may be utilized as the urging means so that the warpage and undulation of the gate region may be eliminated without adding special urging means to the supporting member. As shown in FIG. 7, for example, an arrangement may be made such that an adjusting member 57 as the adjustment means 56 has its bolt threadedly received by the supporting member 51 through a bent portion 53*a* of the support body 53 to which the supporting member is fixed. The resilient deformation of the bent portion 53*a* applies the supporting member with an urging force in a direction of arrow C in the figure, thereby producing a minute quantity (L) of deformation of the supporting member along the direction. This permits a part of the support body 53 to serve as the urging member, negating the need for adding the special urging member. Thus, the reduction of production costs and a size of the apparatus is accomplished.

The image forming apparatus according to the invention is further characterized in that the carrier has an outer circumferential surface shaped like an arc about an axis perpendicular to the transporting direction, protruded toward the control electrode member, and that the control electrode member is curved to protrude toward the counter electrode.

According to the invention, since the carrier is shaped like, for example, a right circular cylinder with the axis horizontally extended whereas the control electrode member is curved to protrude toward the counter electrode, substantially a constant distance is defined between the outer circumferential surface of the carrier and the control electrode member along the circumference of the carrier. Additionally, by selecting a sufficiently great curvature for the curve of the control electrode member, substantially a constant distance is defined between the control electrode member and the counter electrode along the direction of transporting the recording medium so that the degradation of image quality may be avoided.

According to the image forming apparatus of the invention, the warpage and undulation of the control electrode produced in the gate region thereof may be effectively reduced or eliminated by supporting the control electrode which includes a plurality of gates defining passage holes for controlling the passage of the developer.

In this case, the control electrode is supported by the supporting member having the flat surface for holding the control electrode and therefore, the warpage and undulation can be positively eliminated by the very simple construction. This contributes to the reduction of production costs and a size of the apparatus as well as to the improvement of reliability.

On the other hand, the warpage and undulation extending over a wide area can readily be eliminated by adding the adjustment means to the supporting member, the adjustment means applying a force to the supporting member in either direction for deforming the supporting member. In this manner, the developer projection is stabilized thereby eliminating the factor causing the degradation of image quality and providing favorable images. Particularly in the case of forming a color image, various warpage and undulations of respective control electrode can be effectively reduced or eliminated so that favorable color images free from unwanted color tone variation are obtained.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
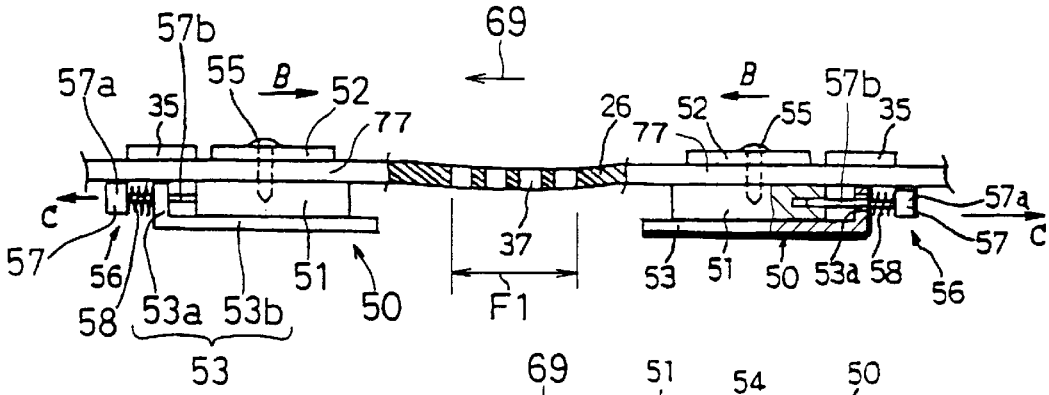
FIGS. 1A to 1C diagrammatically illustrate an embodiment of supporting devices for supporting a control electrode of an image forming station of an image forming apparatus according to the present invention, particularly FIG. 1A being a side view showing in section a region of gates defining toner passage holes of the control electrode, FIG. 1B being a top plan view showing one of the supporting device as seen through the control electrode and FIG. 1C being a partial sectional view of the supporting device taken on line Ic—Ic in FIG. 1B.

Now referring to the drawings, preferred embodiments of the present invention are described below.

Figure 1B:
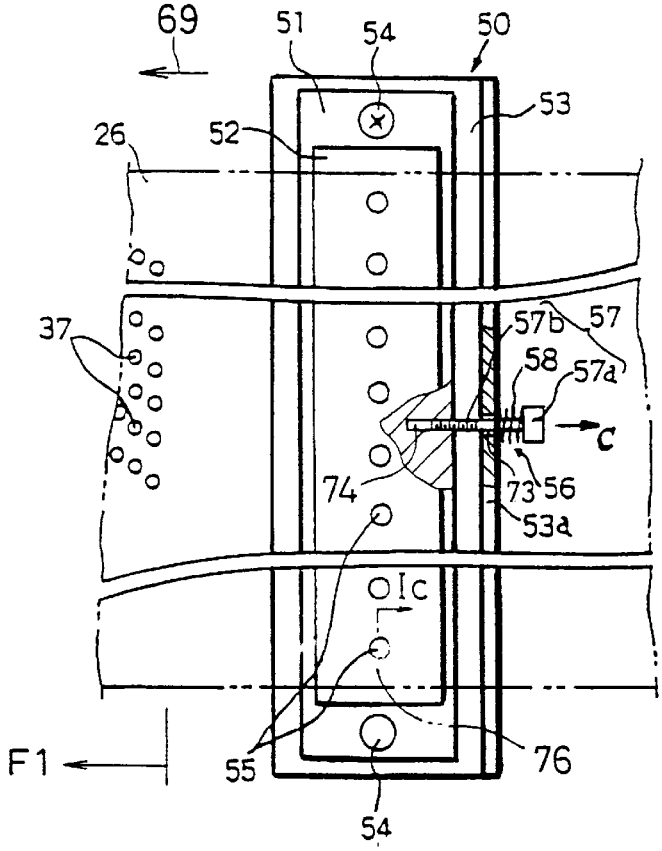
Figure 1C:
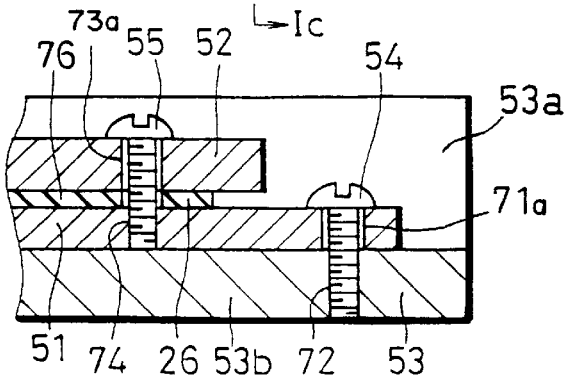
Figure 2A:
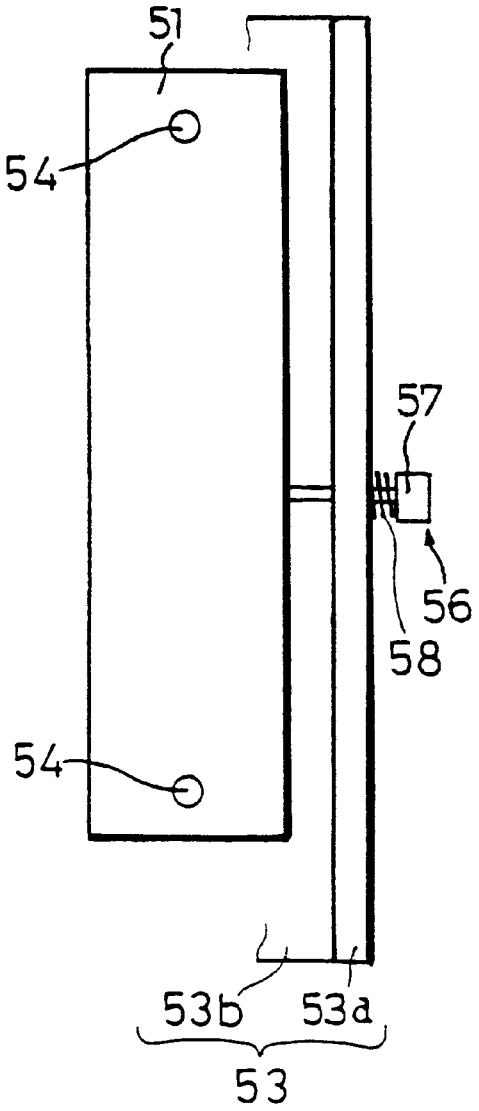
FIGS. 2A to 2B diagrammatically illustrate an adjustment operation by means of the supporting device according to a second embodiment of the invention, particularly FIG. 2A being a top plan view showing a state of the supporting member before subjected to the adjustment and FIG. 2B being a top plan view showing a state of the supporting member after subjected to the adjustment.
Figure 2B:
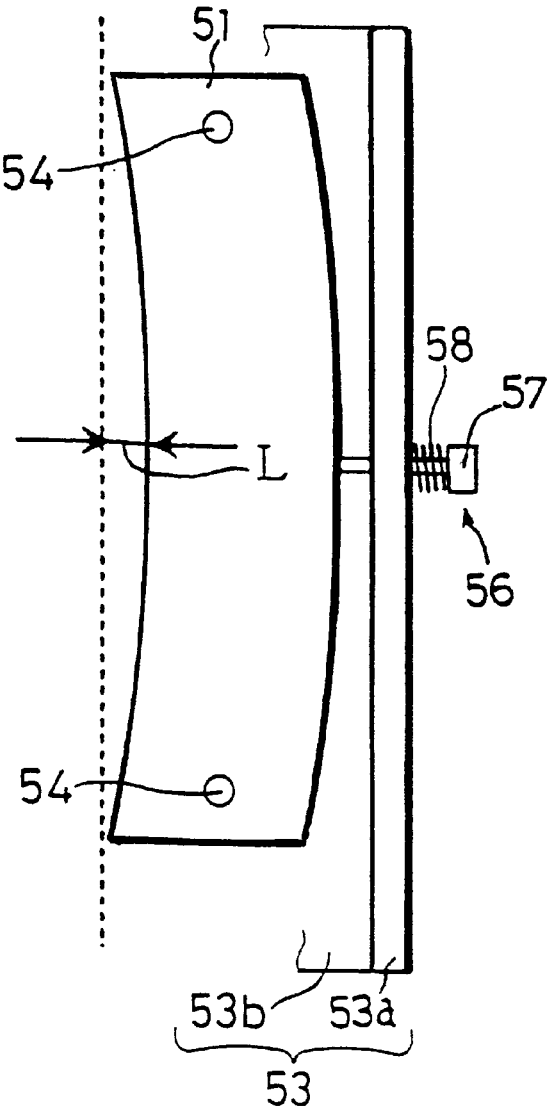
Figure 3:
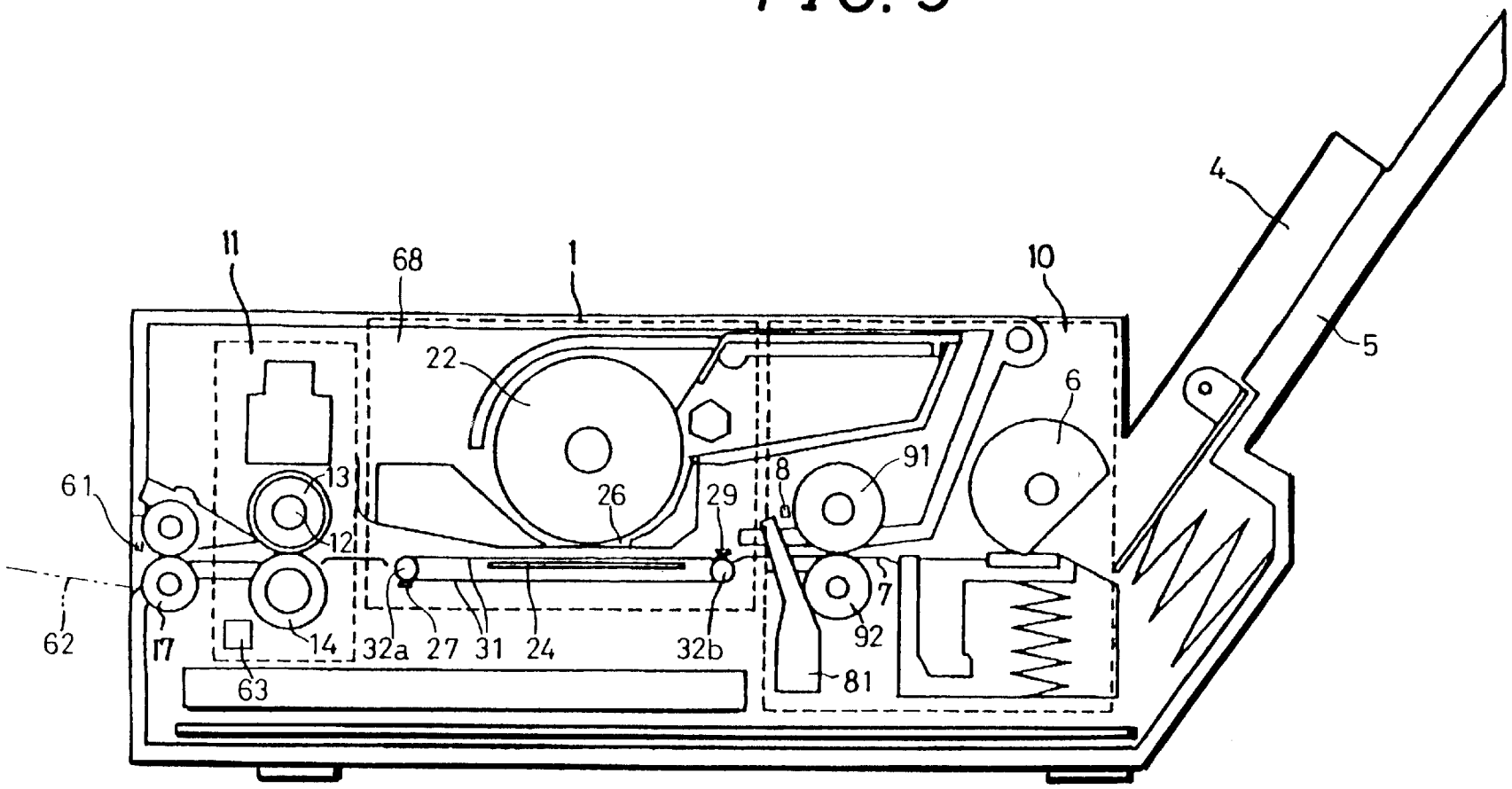
FIG. 3 is a sectional view illustrating an interior construction of a whole body of the image forming apparatus of the invention.
Figure 4:
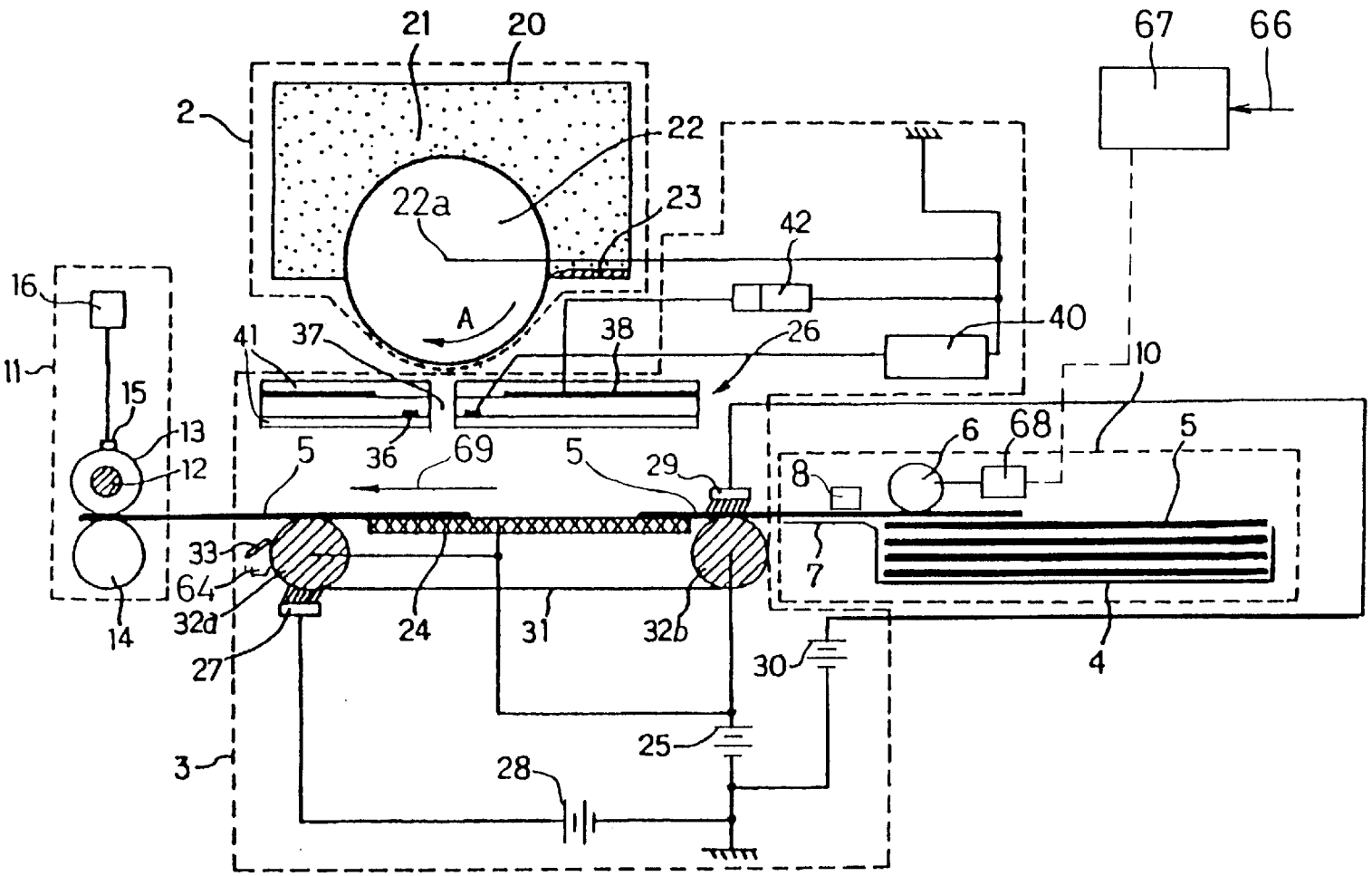
FIG. 4 is a diagram illustrating in detail an image forming station of the image forming apparatus of FIG. 3.

One embodiment of the invention will be described with reference to the accompanying drawings. FIGS. 1A to 1B diagrammatically illustrate an example of a supporting device for a control electrode member 26 disposed in an image forming station of an image forming apparatus in accordance with the invention. Particularly, FIG. 1A is a vertical sectional view of the supporting device whereas FIG. 1B is a plan view thereof. FIGS. 2A to 2B diagrammatically illustrates an operation for fine adjustment of the supporting device of FIG. 1. FIG. 3 is a sectional view for schematically illustrating an interior construction of a whole body of the image forming apparatus in accordance with the invention. FIG. 4 is a diagram for illustrating the image forming station of FIG. 3 in detail.

Now referring to FIGS. 3 and 4, a brief description will be made on components of a printer as the image forming apparatus of the invention. The image forming apparatus of the invention is adapted to develop an image corresponding to an image signal (image data) on a copy sheet (recording paper) 4 as a sheet-like recording medium by the use of a toner as a developer, the image signal transferred from a host computer or the like as an image processor. More specifically, the image forming apparatus of the invention is adapted to form the image directly on the recording paper 4 by selectively controlling the projection of toner based on the image data.

As seen in FIG. 3, the image forming apparatus includes the image forming station 1 at a central portion thereof and a sheet feeder 10 disposed rightwardly of the image forming station 1 as seen in FIG. 3 or upstream thereof in a direction of transporting the copy sheet 4, for feeding copy sheets as the sheet-like recording medium to the image forming station 1. Disposed rearwardly or downstream of the image forming station 1 in the direction of transporting the copy sheet 4 is a fusing station 11 for fusing a produced image, particularly a toner image.

The sheet feeder 10 for feeding the copy sheet to the image forming station 1 at the center of the image forming apparatus, as described above, includes a paper cassette 5 for holding a stack of copy sheets 4, a pickup roller 6 for feeding a copy sheet 4 from the paper cassette 5, a paper guide 7 for guiding the copy sheet 4 thus fed and a pair of registration rollers 9. The sheet feeder 10 further includes a sheet-feed sensor 8 for detecting a feeding of the copy sheet 4 (see FIG. 4). The pickup roller (sheet feeding roller) 6 is driven by a drive (not shown).

The fusing station 11 is disposed on a side to which the image forming station 1 discharges the copy sheet 4, or downstream of the image forming station 1. The fusing station is adapted to heat and press the toner image formed on the copy sheet 4 by the image forming station 1 thereby fixing the toner image onto the copy sheet 4. The fusing station 11 includes a heater 12, a heating roller 13 having the heater 12 inserted therethrough, a pressure roller 14 for pressing the copy sheet 4 against the heating roller 13, a temperature sensor 15 for detection of temperatures of the heating roller 13 and a temperature control circuit 16. The heating roller 13 is formed of, for example, an aluminum tube having a thickness of 2 mm. The heater 12 is composed of a halogen lump, for example, and contained in the heating roller 13. The pressure roller 14 is formed of, for example, a silicone resin material. The heating roller 13 and the pressure roller 14 in opposed relation are subject to a load of 2 kg, for example, by means of a spring (not shown) or the like mounted to opposite ends of respective shafts of the rollers so that the copy sheet 4 may be pressed as held therebetween.

The temperature sensor 15 takes measurement on a surface temperature of the heating roller 13. The temperature control circuit 16 is under control of a main control station, which will be described below, and operates to maintain the surface temperature of the heating roller 13 at 150° C., for example, by exercising ON/OFF control of the heater 12 based on the measurement results supplied from the temperature sensor 15. The fusing station 11 further includes a sheet-exit sensor 61 (not shown) for detecting a discharge of the copy sheet 4. It is to be noted that materials for the heater 12, the heating roller 13 and the pressure roller 14 are not particularly limited. Further, the surface temperature of the heating roller 13 is not particularly limited. Additionally, the fusing station may be adapted to fix the toner image by either heating or pressing the copy sheet 4.

At place to which the fusing station 11 discharges the copy sheet 4, disposed is a sheet exit roller 17 for discharging to a sheet exit tray the copy sheet 4 processed at the fusing station 11 and the sheet exit tray 62 for receiving the copy sheet 4 thus discharged, as shown in FIG. 3. The heating roller 13, the pressure roller 14 and the sheet exit roller 14 are driven by a drive 63.

Next, an arrangement of the image forming station 1 of the invention will be described. The image forming station 1 principally includes a toner supplying section 2 and a printing section 3. The toner supplying section 2 of the image forming station 1 includes a toner storage 20 containing therein a supply of toner 21 as the developer, a toner carrier 22 shaped like a right circular cylinder with a horizontal axis, such as a sleeve of a right circular cylinder, and adapted to magnetically hold the toner thereon, and a doctor blade 23 for charging the toner contained in the toner storage 20 while regulating a thickness of a layer of the toner carried on an outer circumferential surface of the toner carrier 22. The doctor blade 23 is positioned on an upstream side with respect to a direction of rotation A of the toner carrier 22 as spaced, for example, 60 $\mu$m from the outer circumferential surface of the toner carrier 22.

The toner 21 is composed of magnetic toner having a mean particle size of 6 $\mu$m, for example, and is charged by the doctor blade 23 to a charge quantity of −4 $\mu$C/g to −5 $\mu$C/g, for example. It is to be noted that the distance between the doctor blade 23 and the toner carrier 22 is not particularly limited, nor are the mean particle size and the charge quantity of the toner 21.

The toner carrier 22 is driven by a drive (not shown) thereby rotating at a surface speed of, for example, 80 mm/sec. in a direction of arrow A in the figure. The toner carrier 22 is electrically grounded and contains therein magnets (not shown) at places opposite to the doctor blade 23 and to a control electrode 26, which will be described below. The magnets permit the toner carrier 22 to carry the toner 21 on its outer circumferential surface. The toner 21 carried on the outer circumferential surface of the toner carrier 22 is caused to form bristles at places corresponding to the magnets.

It is to be noted that the rotational speed of the toner carrier 22 is not particularly limited. The toner carrier 22 may be arranged to carry the toner 21 by way of an electric force or a combination of the electric force and magnetic force, instead of the magnetic force. The magnetic toner material may be replaced by a toner material composed of a mixture of a thermoplastic resin and carbon black. Such a toner material is attracted to the toner carrier by means of an image force which is an electric force. The toner material may also be replaced by an ink. The toner carrier 22 may be formed of a metal such as aluminum, for example.

The printing section 3 of the image forming station 1 includes a counter electrode (back plate) 24 formed of a metal sheet, such as of aluminum, having a thickness of 1 mm, for example, and opposing the outer circumferential surface of the toner carrier 22; a counter-electrode voltage source 25 for supplying a high voltage to the counter electrode 24; a control electrode member 26 interposed between the toner carrier 22 and the counter electrode 24; a static eliminating member 27 such as formed of a brush or roller; a static-elimination voltage source 28 for applying a static-elimination potential to the static eliminating member 27; a charging member 29, such as formed of a brush or roller, for charging the copy sheet 4; a charging voltage source 30 for applying a charging potential to the charging member 29; a belt 31 formed of a dielectric material; a pair of supporting rollers 32*a,* 32*b* each having a horizontal axis and supporting the dielectric belt 31; and a cleaner blade 33.

The counter electrode 24 is located at a distance of, for example, about 1.1 mm from the outer circumferential surface of the toner carrier 22. The dielectric belt 31 is an endless belt which has a thickens of about 75 $\mu$m and is formed of a material including PVDF (polyvinylidene fluoride) as a base material and having a volume resistance of about $10^{10}$ Ω·cm. The dielectric belt 31 is driven by a drive (not shown) thereby rotating at a surface speed of, for example, 30 mm/sec. in a direction of arrow 69 in the figure.

The counter electrode 24 is applied with a high voltage of, for example, 2.3 kV by the counter-electrode voltage source 25. That is, an electric field required for projecting the toner 21 from the toner carrier 22 toward the counter electrode 24 is applied between the counter electrode 24 and the toner carrier 22 by means of the high voltage supplied from the voltage source 25.

The static eliminating member 27 is disposed at place downstream in the direction of rotation of the dielectric belt 31, as pressed thereagainst. The static eliminating member 27 is applied with a static-elimination potential of 2.5 kV by the static-elimination voltage source 28 so that unwanted charges remaining in the surface of the dielectric belt 31 may be eliminated. It is to be noted that a material for the counter electrode 24 is not particularly limited, nor is the distance between the counter electrode 24 and the toner carrier 22. Further, the voltage applied to the counter electrode 24 is not particularly limited.

The blade 33 is disposed near the drive roller 32*a* in a manner to have its distal end abutted against the dielectric belt 31. The blade 33 serves as a cleaning member for scraping off the toner material adhering to the surface of the dielectric belt 31 due to, for example, jamming of the copy sheet(s) 4. Thus is prevented the contamination of a back side of a copy sheet with the toner material remaining on the dielectric belt 31 in an image forming process subsequent to the removal of the jammed sheet. A toner recovery vessel 64 for receiving the scraped toner material is provided in corresponding relation to the cleaning blade 33.

The image forming apparatus of the invention is capable of receiving image data not only from an external source, as described in the foregoing, but also from a reading scanner or the like which reads an original document or the like. More specifically, the main body of the image forming apparatus includes a scanner as well as an image processing station for processing image data obtained by the scanner into such data as are reproducible by the image forming station, a control station for controlling the image forming apparatus as a whole, a storage station for storing image data as required, and a conversion station for converting the image data into data to be supplied particularly to the control electrode member 26 of the image forming station according to the invention.

The control electrode member 26 extends in parallel with a tangential direction to a surface of the counter electrode 24 and two-dimensionally in opposed relation to the counter electrode 24. The control electrode member is so constructed as to permit a toner flow from the toner carrier 22 to pass therethrough to the counter electrode 24. The control electrode member 26 is curved to protrude downward as seen in FIGS. 1A, 3 and 4, or toward the counter electrode 24, as described later. Thus, the control electrode member 26 is arranged along the arcuate outer circumferential surface of the carrier 22 at substantially the same distance therefrom, which the arcuate outer circumferential surface of the carrier 22 protrudes toward the control electrode member 26. The electric field applied between the toner carrier 22 and the counter electrode 24 is varied due to a potential applied to the control electrode member 26 whereby the projection of the toner 21 from the toner carrier 22 to the counter electrode 24 is controlled. The control electrode member 26 is fixed to place by supporting members 51, as spaced, for example, 100 $\mu$m from the outer circumferential surface of the toner carrier 22.

Figure 5:
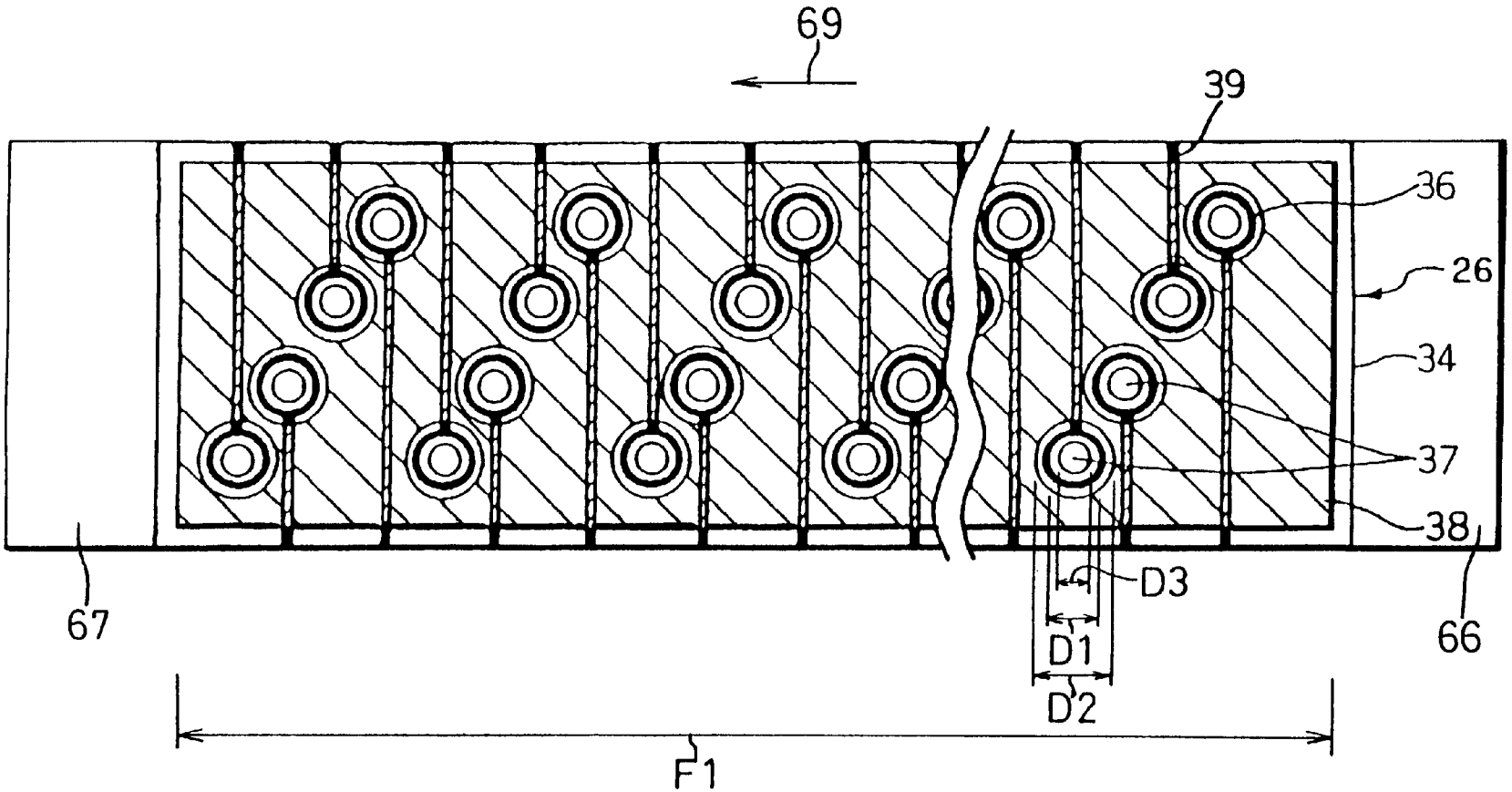
FIG. 5 is a plan view illustrating an exemplary arrangement of the control electrode of the image forming station according to the invention.

FIG. 5 is a plan view illustrating one exemplary configuration of the control electrode member 26 according to the invention. The control electrode member 26 includes an electrically insulating substrate 34, high-voltage drivers 35 (see FIG. 1) and ring electrodes 36 shaped like a ring and independent from one another. Specifically, the ring electrode 36 is formed with an aperture defining a passage hole 37 permitting the passage of the toner. The substrate 34 is provided with a sheet of screen electrode 38 on its surface opposite to the toner carrier 22 for allowing or prohibiting the passage of the toner. The screen electrode 38 is represented by oblique lines for simplification of the illustration.

The insulating substrate 34 is formed of, for example, a flexible polyimide resin and in a thickness of 25 $\mu$m.

The ring electrodes 36 are formed of, for example, an about 18-$\mu$m thick copper foil, including the passage holes or gates 37 at their respective apertures of an electrode 38. The ring electrodes are formed according to a predetermined arrangement. Each passage hole 37 defines a passage through which the toner 21 are projected from the toner carrier 22 to the counter electrode 24. Hereinafter, the passage is referred to as "gate 37".

The screen electrode 38 is formed of, for example, a copper foil and with apertures correspondingly to the respective gates 37 and ring electrodes 36 surrounding the gates 37. Particularly, the aperture 37 of the ring electrode 36 has an inside diameter (a diameter) D1 of, for example, about 200 $\mu$m whereas the aperture of the screen electrode 38 has an inside diameter D2 of, for example, about 240 $\mu$m. The gates 37 are concentrically formed in the respective apertures of the ring electrodes 36 and of the screen electrodes 38 in correspondence, having a diameter D3 of, for example, about 160 $\mu$m.

It is to be noted that the distance between the control electrode member 26 and the toner carrier 22 is not particularly limited. Likewise, the size of the gate 37 and the materials for and thicknesses of the insulating substrate 34, the ring electrode 36 and the screen electrode 38 are not particularly limited. Incidentally, since the screen electrode 38 operates to supply a potential such as to prohibit the projection of the toner, there may be a case where the screen electrode is omitted.

Although the number of gates 37 formed in the substrate 34 is not limited, there are formed 2560 gates, for example, in order to form dots at 300 dpi (dot per inch) on an A4-size copy sheet. The respective electrodes 37 and the screen electrode 38 are electrically connected to a control-electrode voltage source 40 via respective feeder lines 39 and the high-voltage drivers 35.

The surfaces of the ring electrodes 36 and the screen electrode 38 are covered with an insulating layer 41 or the like (see FIG. 4) having a thickness of about, for example, 30 $\mu$m, the insulating layer ensuring that the respective electrodes are electrically isolated from one another. Incidentally, the material for and thickness of the insulating layer 41 are not particularly limited.

The control-electrode voltage source 40 applies a pulse or a voltage corresponding to an image signal to the ring electrodes 36 and screen electrode 38 of the control electrode member 26 as described above. More specifically, the control-electrode voltage source 40 is adapted to apply to the ring electrodes 36, for example, either 150 V (hereinafter referred to as "ON potential") for permitting the toner 21 from the toner carrier 22 to pass through the ring electrodes 36 in the counter electrode 24 direction, or −200 V (hereinafter referred to as "OFF potential") for prohibiting the passage of the toner therethrough, the potentials switched by way of the high-voltage driver 35. The ON potential for projecting the toner and the OFF potential for prohibiting the toner-projection are not particularly limited and an optimum potential for the toner-projection may be defined as required.

In the toner-projection, a voltage source 42 supplies to the screen electrode 38 via the high-voltage driver 35 an equal level of potential to that applied to the ring electrodes 36 for toner-projection as described above. Similarly in the prohibition of the toner-projection, the voltage source supplies to the screen electrode 38 an equal level of potential to that applied to the ring electrodes 36 for prohibiting the toner-projection.

Now, description will be made on a sequence of image forming steps performed by the image forming apparatus of the invention. First, the main control station of the image forming apparatus starts the image forming operations in response to image data sent from the host computer or the scanner as the image reading device.

That is, upon receipt of the image data through a line 66, a processing circuit 67 of the image forming apparatus starts the image forming operations. At this time, the pickup roller 6 shown in FIG. 4 is caused to rotate by a drive 68 for feeding a copy sheet 4 from the paper cassette 5 to the image forming station 1 while the sheet-feed sensor 8 detects the execution of sheet feeding in a normal state. Responding to this, the processing circuit 67 directs to transport the copy sheet 4 fed by the pickup roller 6 to a place between the charging member 29 and the supporting roller 32*b*. The supporting roller 32*b* is supplied from the voltage source 25 with a potential substantially equal to that applied to the counter electrode 24. The charging member 29 is applied with a charging potential of 1.2 kV by the charging voltage source 30. The copy sheet 4 is charged at a potential of a difference between the potentials of the charging member 29 and of the supporting roller 32*b*, so that as electrostatically attracted to the dielectric belt 31, the copy sheet 4 is carried thereon to a place in the printing section 3 of the image forming station 1, at which place the dielectric belt 31 is opposed by the toner carrier 22.

Subsequently, the control-electrode voltage source 40 supplies a potential to the ring electrodes 36 of the control electrode member 26 based on the image data. This potential supply is timed to synchronize with the feeding speed of the copy sheet 4 from the charging member 29 to the printing section 3. Based on the image data, the control-electrode voltage source 40 applies either the ON potential or the OFF potential, as required, to suitably selected control electrode member 26 or ring electrodes 36. On the other hand, the screen electrode 38 is applied with the ON potential by the voltage source 42 as timed to the starting of the image forming operations. This provides a control of the electric field established in the vicinity of the control electrode member 26. More specifically, based on the image data, the respective gates 37 of the control electrode member 26 either prohibit or cancel the prohibition of the projection of the toner 21 from the toner carrier 22 to the counter electrode 24.

In this manner, a toner image corresponding to the image data is formed on the copy sheet 4 which is transported by the supporting rollers 32*a*, 32*b* to the sheet exit side at the speed of 30 mm/sec. The copy sheet 4 with the toner image formed thereon is separated from the dielectric belt 31 due to a curvature of the supporting roller 32*a*, thus delivered to the fusing station 11. Subsequently, the fusing station 11 fixes the toner image to the copy sheet 4. The copy sheet 4 with the toner image fixed thereto is discharged to the sheet exit tray by means of the sheet exit roller 17 (see FIG. 3) while the sheet-exit sensor detects a normal sheet discharge. Responding to this detection, the main control station 67 determines that a normal printing operation is completed. FIG. 4 partially omits the line connected to the processing circuit 67.

The passage holes 37 are formed in the control electrode member 26 with their respective centers shifted from those of adjacent passage holes with respect to a crosswise direction of the control electrode member 26, which direction is perpendicular to the transporting direction 69 the copy sheet 4 (a perpendicular direction with respect to the surface on which FIG. 4 is drawn or a vertical direction as seen in FIG. 5). This allows a continuous straight line to be drawn crosswise of the copy sheet 4 (the vertical direction as seen in FIG. 5 as described above) by selectively controlling the ring electrodes 36 corresponding to the respective passage holes 37 while the copy sheet 4 is moved in the transporting direction 69.

Through the image forming operations, a favorable image is formed on the copy sheet 4. The image forming apparatus of the invention is adapted to form the image directly on the copy sheet 4, thus negating the need for the development device including the developer such as a photoconductor, a dielectric drum and the like, which is employed by the prior-art image forming apparatuses. Since the image forming apparatus of the invention omits the image transfer operation for transferring the image from the development device to the copy sheet 4, the resultant image is prevented from being degraded. Hence, the image forming apparatus of the invention is not only improved in reliability but also features a simplified construction as well as reduced size and costs by virtue of the decreased number of components thereof.

First Embodiment of the Invention

Now, detailed description will be made particularly on a construction of the supporting device for the control electrode member 26 of the printing section 3 of the image forming station 1. More specifically, the supporting device of the invention is adapted to support the control electrode member 26 in a manner to reduce or eliminate warpage and undulation produced in the control electrode member 26 for stabilizing the state of passage of the toner.

As seen in FIG. 1, the control electrode member 26 is supported by supporting devices 50 of the invention at regions 76, 77 thereof at opposite sides with respect to the transporting direction 69. Since the supporting devices 50 on the opposite sides of the electrode member has an identical construction, the description will be made with reference to one of the supporting devices 50.

The supporting device 50 has a supporting member 51 formed of a metal, such as aluminum. The control electrode member 26 is mounted to the supporting device by fixing the region 76 or 77 thereof to the supporting member 51, which cooperates with a fixing member 52 formed of a metal and in upper positional relation thereto so as to hold the region therebetween. As seen in FIG. 1C, the supporting member 51 is secured to a horizontal portion 53*b* of a support body 53 at its crosswise (or perpendicularly) opposite end portions with respect to the direction of transporting 69 the copy sheet 4 by means of machine screws 54, the support body 53 securely retained at a predetermined position in the image forming apparatus body 78 and having an L-shaped sectional form. Thus, the control electrode member 26 is fixed to a position set by the support body 53 because the control electrode member is secured to the supporting member 51 as held between flat portions of the supporting member 51 and of the fixing member 52.

The fixing member 52 is fixed to the supporting member 51 by means of a plurality of fixing screws 55 extending through the control electrode member 26. The regions 76, 77 of the control electrode member 26, which are held between the fixing member 52 and the supporting member 51, are spaced far along the transporting direction 69 from a region F1 where the feeder lines 39 are laid out for supplying a predetermined potential to the ring electrodes 36 controlling the passage of the toner, or a recording region F1 where the gates 37 are formed. The ring electrodes 36 are connected to the voltage source 40 of FIG. 4 via the high-voltage drivers 35 and the feeder lines 39. The feeder lines 39 are extended in a manner to circumvent a portion penetrated by the fixing screws 55, thus prevented from establishing a short circuit via the screws 55 and the fixing member 52.

As seen in FIG. 1A, the supporting member 51 and the fixing member 52 has flat surfaces opposing each other, so as to securely hold the control electrode member 26 between their respective flat surfaces. Thus, the control electrode member 26 is held at its opposite sides with respect to a direction of its thickness (a vertical direction as seen in FIG. 1A) so as to eliminate the warpage and undulation produced in the control electrode member 26. Furthermore, the entire body of the control electrode member 26 is subject to a uniform holding pressure without locally concentrated pressure, so that deformation of the control electrode member 26 or a locally concentrated pressure may not cause stress concentration which leads to a failure of the control electrode member 26.

As described above, the control electrode member 26 is mounted by way of the supporting member 51 and the fixing member 52 holding the control electrode member therebetween at the opposite sides of the control electrode member with respect to the direction of its thickness. On the other hand, the supporting device 50 is arranged such that the supporting member 51 is fixed to the support body 53 fixed to the image forming apparatus body 78. This allows a simple construction to support the control electrode member 26 at position in an easy and precise manner, negating the need for a special member for the support. Furthermore, the decreased number of the components contributes to an increased reliability as well as to the reduction of size and costs of the apparatus.

When the supporting devices 50 are employed for fixing the control electrode member 26 to a predetermined position, the supporting members 51 are fixed to the support bodies 53 retained at predetermined positions by means of the screws 54 as applying forces toward each other (in directions shown by arrows B in FIG. 1) with the region F1 of the gates 37 interposed therebetween. This brings the control electrode member 26 into a position resiliently curved downward as seen in FIG. 1 (toward the counter electrode 24) at the region F1 of the gates 37.

When supported at place, the control electrode member 26 defines a curved portion protruding toward the counter electrode 24 at its gate region F1 of the gates 37 serving as the recording portion. That is, the slight warpage and undulation of the control electrode member 26 produced in the production process is reduced or eliminated by curving a part of the control electrode member 26, particularly the region F1 of the gates 37 serving as the recording portion. This allows the region F1 of the gates 37 to form a smooth curved surface for providing consistent conditions for the toner-projection, stabilizing the toner-projection and preventing the degradation of image quality.

In such a construction, the warpage and undulation of the, particularly of the region F1 of the gates 37, which is produced in the production process of the control electrode member 26, may be eliminated. Consequently, the precision of spacing between the toner carrier 22 and the control electrode member 26 is substantially restricted within a range of between ±10 and ±20 $\mu$m so that quite a high mounting precision can be achieved.

It is to be noted that the forming region F1 of the gates 37 of the control electrode member 26 should be curved to a degree that warpage and undulation affecting the toner-projection can be eliminated. On the other hand, the control electrode member 26 should be spaced from the toner carrier 22 and from the counter electrode 24, respectively, at substantially constant distances along a crosswise direction of the control electrode member, or a direction perpendicular to the transporting direction 69 (perpendicular to the face on which FIGS. 3 and 4 are drawn). That is, the control electrode member should be positioned in a manner that the respective spaces therebetween may not vary greatly with respect to the crosswise direction thereof. If the control electrode member is curved too deep, the respective spaces have great variations with respect to the crosswise direction of the control electrode member and the degradation of image quality results. Therefore, it is preferred to curve the control electrode member to a degree that the degradation of image quality does not result.

Second Embodiment of the Invention

As described in the foregoing, the first embodiment of the invention provides an effective elimination of the warpage and undulation of the control electrode member 26 produced in the course of the production thereof. More specifically, according to the manner, the warpage and undulation extending over a relatively small area F1 may effectively eliminated because the supporting member 51 and the fixing member 52 of the supporting device 50 are used to apply a force consistently to the control electrode member 26 along the crosswise direction thereof, which direction is perpendicular to the direction of transporting 69 the copy sheet 4.

In cases where the control electrode member 26 suffers the production of warpage and undulation in a greater area or the production of a great degree of warpage and undulation in a small area, the arrangement according to the first embodiment of the invention fails to eliminate such warpage and undulation. In this respect, the supporting device 50 for the control electrode member 26 adapted to effectively eliminate even the warpage and undulation extending over a great area will be described with reference to the second embodiment of the invention.

Figure 6B:
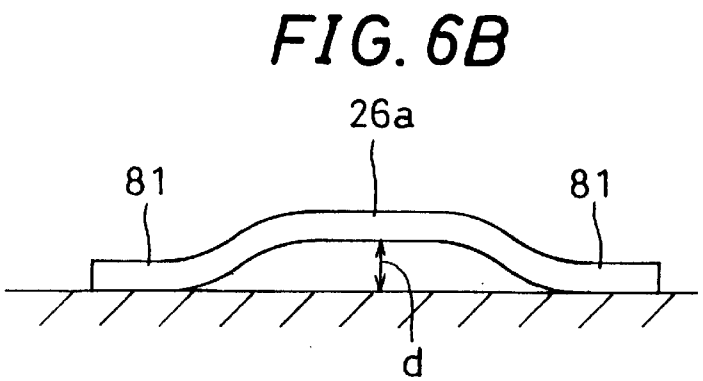
FIGS. 6A to 6C diagrammatically illustrate a state of warpage and undulation extending over a wide area of the control electrode according to the invention.
Figure 6C:
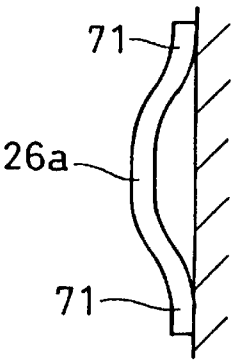
Figure 6A:
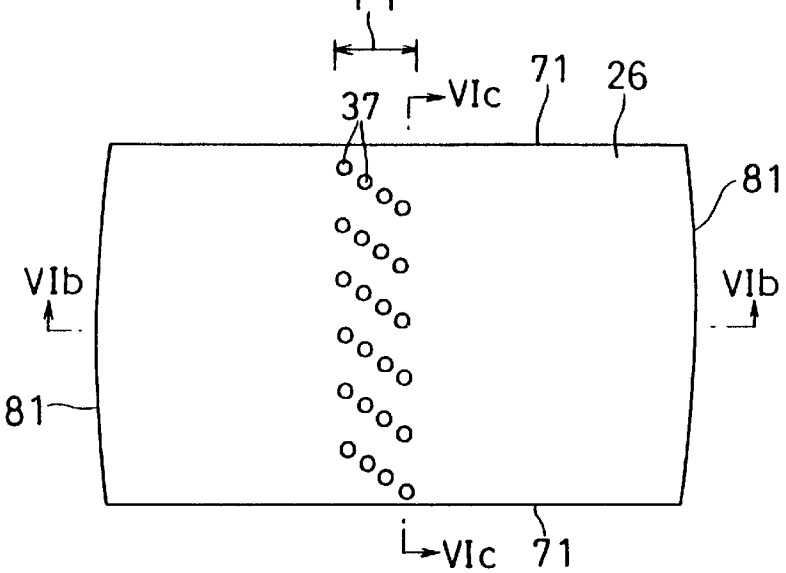

A reason for frequent occurrences of the warpage and undulation in a relatively large area of the control electrode member 26 is because the passage holes 37, the feeder lines 39 and the ring electrodes 36 are formed in the region F1 of the gates 37 of the control electrode member 26 in high densities. In a case where the control electrode member 26 of this construction is mounted to place in a manner described by way of example of the first embodiment of the invention as described above, the control electrode member 26 cannot adequately accommodate a protrusion produced in the crosswise direction thereof, which direction is perpendicular to the sheet transporting direction 69, as shown in a sectional view of FIG. 6B taken on line VIb—VIb in FIG. 6A. Further, as shown in FIG. 6C taken on line VIc—VIc in FIG. 6A, the region F1 is elongated to produce a protrusion extending along the transporting direction 69. This results in an appearance of deformation (gap d) in the control electrode member 26 wherein a central portion 26*a* thereof is protruded a few dozens micrometers from longitudinal end portions of the region F1 of the gates 37.

Accordingly, a space between the gates 37 and the toner carrier 22 is constantly greater at the central portion 26*a* of the region F1 than at crosswise end portions 71 of the control electrode member. As a result, the end portions 71 have different conditions of projection of the toner 21 from those of the central portion 26*a*. In this case, a degraded image results because of different qualities of image portions produced at the end portions and at the central portion.

More specifically, the image portions produced at the crosswise end portions 71 constantly have higher image densities than that produced at the central portion 26*a*, or one continuous line formed along the crosswise direction becomes thinner at an intermediate part thereof. In addition, a halftone image is reproduced in different states at the end portions 71 and at the central portion 26*a*. In the case of forming a color image, the colors are reproduced in different states at the end portions 71 and at the central portion 26*a*.

In order to eliminate such drawbacks, the supporting of the control electrode member 26, particularly of the central portion 26*a* thereof must be subject to fine adjustment with precision of several micrometers. Unfortunately, such a fine adjustment cannot be performed on the supporting structure exemplified by the first embodiment of the invention, for example.

Hence, the second embodiment of the invention offers a supporting device permitting the fine adjustment to a portion of the supporting member 51, which requires such a fine adjustment. In the instance of FIG. 6, the central portion 26*a* requires the fine adjustment.

As seen in FIG. 1, the supporting device 50 according to this embodiment includes adjustment means 56 for performing the fine adjustment. The adjustment means 56 for fine adjustment includes an adjusting member 57 as screw means composed of a male screw portion 57*b* or the like, which extends loosely through a through hole 73 in a bent portion 53*a* of the L-shaped support body 53 and partially threadedly received by a female screw hole 74 of the supporting member 51, and a spring-urging member 58 such as of a compression spring interposed between a head 57*a* of the adjusting member 57 and the bent portion 53*a* of the support body 53.

The adjusting member 57 is located at a central place crosswise of the control electrode member 26, as shown in FIG. 1B. The adjusting member 57 is arranged such that the male screw portion 57*b* continuous to the head 57*a* thereof extends through the through hole 73 in the bent portion 53*a* of the support body 53 to be threadedly received by the female screw hole 74 of the supporting member 51, thereby urging the supporting member 51 in a direction of arrow C in FIG. 1 by means of an urging force of the urging member 58. By adjusting a length of the male screw portion 57*b* extending between the right end surface of the supporting member 51 as seen in FIG. 1B and the head 57*a* of the screw 57, adjustment may be made to the rightward urging force applied by the urging member 58 to the central portion crosswise (vertical direction in FIG. 1B) of the supporting member 51.

FIG. 1C is a partial sectional view of the supporting member taken on line Ic—Ic in FIG. 1B. A bolt 54 extends loosely through a through hole 71*a* formed in the supporting member 51 so as to be threadedly received by a female screw hole 72. A bolt 55 extends loosely through a through hole 73*a* formed in the fixing member 52 so as to be threadedly received by a female screw hole 74*a* formed in the supporting member 51. The control electrode member 26 is fixed to place as held between the flat portions of the supporting member 51 and of the fixing member 52 in opposed relation. The supporting member 51 is loosely mounted to the support body 53 by means of the bolts 54 for a relative movement between a top surface of the support body 53 in FIG. 1C and a bottom surface of the supporting member 51 such that the central portion of the supporting member 51 in FIG. 1C may be displaced on the surface of the support body 53 when the supporting member 51 is pulled by the adjustment means 56 rightwardly as indicated by arrow C in FIG. 1B.

The supporting member 51 is adapted to be pulled in the direction of arrow C in the figure by screwing in the adjusting member 57.

In this construction, by manipulating the adjustment means 56 or more specifically by turning the adjusting member 57 in the form of a screw, the urging force of the urging member 58 is varied for adjustment of the force applied to the supporting member 51.

The adjustment of the supporting member 51 will specifically be described by way of reference to FIG. 2. Secured to the support body 53 fixed to a predetermined position are the crosswisely opposite end portions 71 of the supporting member 51 by means of the screws 54, the crosswise direction being perpendicular to the direction of transporting 69 the copy sheet 4. FIG. 2A illustrates a state in which the adjusting member 57 as the adjustment means 56 is not manipulated so that the supporting member 51 is not deformed. An effect of turning the adjusting member 57 or screwing the adjusting member 57 into the supporting member 51 combines with the urging force of the urging member 58 to produce a minute quantity (L) of deformation of the supporting member, as shown in FIG. 2B. With the undeformed supporting member 51 indicated by a broken line in the figure, the supporting member 51 is subject to a quantity L of deformation at the central portion thereof because the opposite end portions thereof are fixed to the support body 53 by means of the screws 54.

That is, by turning the adjusting member 57 of the adjustment means 56, the force in the direction of arrow C in FIG. 1B is applied to the supporting member 51 by means of the urging member 58 and the adjusting member 57, thereby deforming the supporting member 51, which is substantially a rigid body, as shown in FIG. 2B. This deformation accommodates the great degree of warpage and undulation produced in the region of the gates 37 of the control electrode member 26, as shown in FIG. 6, whereby the warpage and undulation is reduced or eliminated. The supporting member 51 may be formed of a metal sheet having, for example, a thickness of 1 to 2 mm, such as an aluminum sheet.

According to this embodiment of the invention, the supporting member 51 is substantially of a rigid body such as formed of aluminum and has its crosswisely opposite end portions fixed to the support body 53 such as formed of stainless steel (SUS) by means of the screws 54 or the like. On the other hand, by applying a degree of force to the central portion of the supporting member, a slight deformation on a several-micrometer basis, for example, can be produced in the supporting member 51. When there is no large difference in strength between the bent portion 53*a* of the support body 53 and the supporting member 51, this permits the supporting member 51 to be slightly deformed in the aforementioned manner. Such a slight deformation may be produced resiliently or plastically.

In the adjustment mechanism as shown in FIG. 1, a quantity of slight deformation (L) to be produced is, for example, about 50 $\mu$m corresponding to a force of 1 kg applied by the urging means 58. This quantity of deformation enables the fine adjustment to the control electrode member 26. Further, a fine adjustment to the quantity L of the deformation of the supporting member 51 can readily be made on a several-micrometer basis by means of the adjusting member 57 which adjusts the force applied to the supporting member.

According to the construction of the adjustment device 56 shown in FIG. 1, the quantity of adjustment 'L' illustrated in FIG. 2 may be arbitrarily changed thereby to reduce the quantity of deformation 'd' due to the extensive warpage and undulation shown in FIG. 6 to 10 $\mu$m or less.

As described in the foregoing, the supporting device for the control electrode member 26 according to the second embodiment of the invention permits a very simple construction to accomplish a delicate fine adjustment. Accordingly, the supporting device of the second embodiment is quite effective for the adjustment of deformation associated with a slight warpage and undulation of the control electrode member.

Hence, the adjustment means 56 disposed at the supporting device 50 provides the fine adjustment to the force applied to the supporting member 51 corresponding to a degree of the warpage and undulation produced in the control electrode member 26 thus supported, thereby allowing the supporting device to support the control electrode member 26 in a favorable state free from the deformation due to the warpage and undulation therein. This is effective to stabilize the conditions for the toner-projection and prevent the degradation of image quality.

It is to be noted that the supporting member 51 and the support body 53 according to the foregoing embodiments of the invention are of rigid bodies formed of metal but should not be limited to these. The supporting member and support body may be formed of a resin material or glass if a predetermined fine adjustment is provided. However, the support body 53 is formed of a member having a greater strength than the supporting member 51 for prevention of the deformation of the support body 53 and fixed to the predetermined place of the image forming apparatus body 78 of the invention.

According to the description, the urging member 58 employs the compression spring but should not be limited to this. The urging member may employ any resilient member that can apply a predetermined force, such as a plate spring, resilient rubber and the like.

Figure 7:
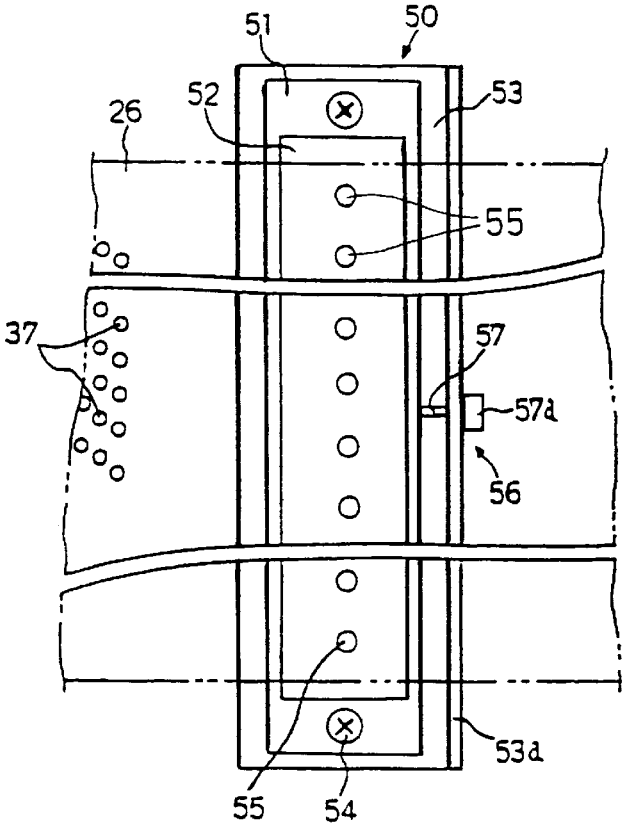
FIG. 7 is a top plan view of an exemplary arrangement of adjustment means disposed at the supporting device for the control electrode according to the second embodiment of the invention.

An alternative arrangement may be made such that, instead of utilizing the urging member 58 composed of the spring, the adjusting member 57 is adapted to pull the supporting member 51 with the head 57*a* of the adjusting member 57 pressed against the bent portion 53*a* of the support body 53. FIG. 7 illustrates an example of this arrangement.

As seen in FIG. 7, a gap between the supporting member 51 and the bent portion 53*a* of the support body 53 can be varied by the adjusting member 57 of the adjustment means 56 while a resilient force of the bent portion 53*a* of the support body 53 is utilized to apply the force to the supporting member 51, as described with reference to FIG. 2, whereby the deformation(L) of the supporting member for the fine adjustment is accomplished. Such an arrangement negates the need for the urging means 58, thus contributing to the reduction of the number of parts, size of the apparatus and the production costs as well as to the improvement of reliability.

The urging member 58 added to the adjustment means 56, as described in the foregoing, serves to relieve unwanted pressures acting in directions intersecting with the transporting direction 69 thereby restricting to the transporting direction 69 the force applied to the supporting member 51 for the deformation thereof. This permits the supporting member 51 to receive a stable force such that the deformation thereof is produced in stable conditions under which a stable fine adjustment is performed. As a result, the effect of eliminating the warpage and undulation of the control electrode member is promoted.

Unlike the first embodiment wherein a part of the control electrode member 26, particularly the region formed with the gates 37 is curved for elimination of the warpage and undulation, the second embodiment of the invention accomplishes the elimination of the warpage and undulation by the effect of the supporting device alone. On the other hand, by practicing the second embodiment in combination with the arrangement of the first embodiment wherein a part of the control electrode member is curved, the effect of eliminating the deformation of the control electrode member 26 due to the warpage and undulation thereof is promoted even further for stale image forming operations.

Modifications from the Second Embodiment of the Invention

The adjustment means 56 added to the supporting device 50 for the control electrode member 26 according to the second embodiment of the invention is designed to eliminate the warpage and undulation of the control electrode member 26, which is formed like a protrusion at the center of the electrode member, as shown in FIG. 6. That is, the adjustment means is adapted to apply the force to the central portion 26*a* of the electrode member.

Figure 8:
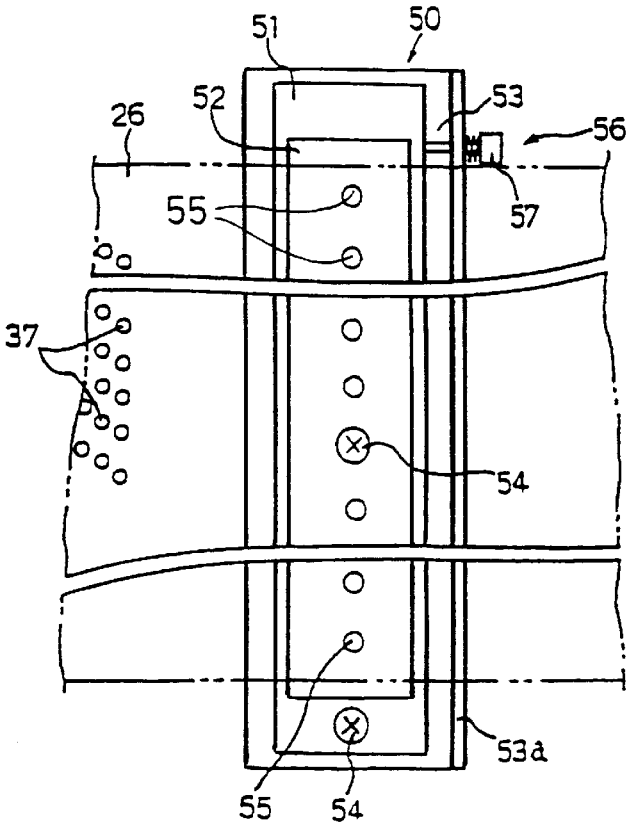
FIG. 8 is a top plan view of another exemplary arrangement of the adjustment means disposed at the supporting device according to the second embodiment of the invention.

The arrangement may be directed to the elimination of a warpage and undulation produced at the other portion than the central portion. There may be made an arrangement, as shown in FIG. 8 for example, such that the supporting member 51 is fixed to the support body 53 with the screws 54 at the central and one end portions thereof while an adjustment means 56 analogous to that of FIG. 1 is provided at place corresponding to the other unfixed end portion of the supporting member for performing the adjustment operation. In a case where warpage and undulation is produced at an end portion of the control electrode member, the adjustment means 56 may be provided at place corresponding to the portion in question. Thus, a favorable arrangement may be made in that a portion to receive the force or the degree of force applied to that portion is suitably changed depending upon the place and degree of deformation due to the warpage and undulation of the control electrode member 26 to be supported.

In the arrangement of the second embodiment of the invention, the supporting member 51 is fixed to place at two points 54 of the crosswisely opposite end portions thereof but the fixing points are not limited to the above. For example, the supporting member may be fixed at three points thereof and the adjustment means 56 may be suitably disposed for elimination of the warpage and undulation.

Figure 9:
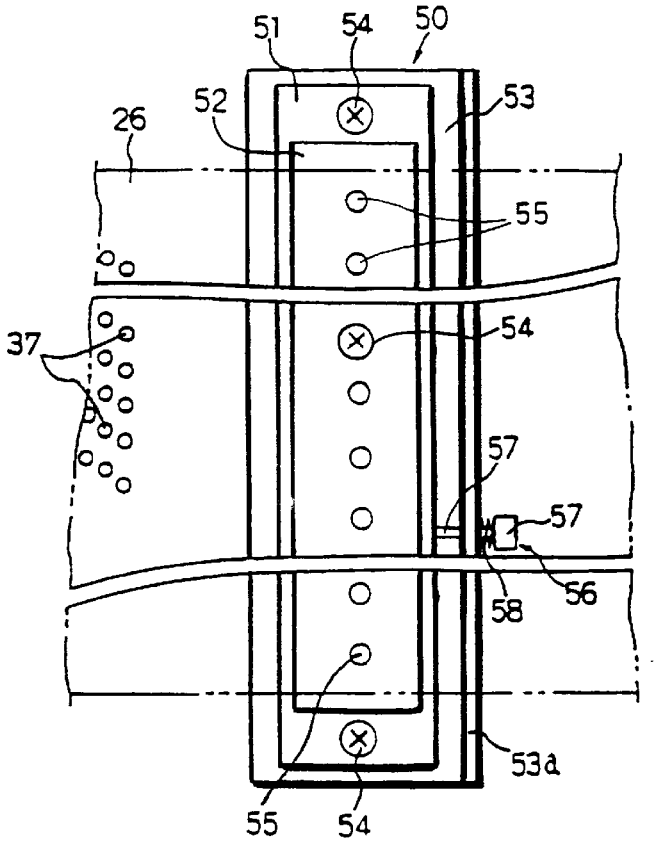
FIG. 9 is a top plan view of still another exemplary arrangement of the adjustment means disposed at the supporting device according to the second embodiment of the invention.

In this case, the adjusting member 57 of the adjustment means 56 and the urging member 58 are not disposed at the intermediate portion of the supporting device 50 but may be disposed at a suitable place corresponding to where warpage and undulation of the control electrode member 26 occurs, thereby eliminating a deformation thereof. For example, the adjusting member and urging member may be disposed at place shifted from the intermediate portion toward either of the end portions of the support device, as shown in FIG. 9.

In the foregoing embodiments of the invention, the fine adjustment is accomplished by subjecting the supporting member 51 to the pulling force in the direction of arrow C in FIG. 1, for example. Conversely, there may be made an arrangement such that a force acting in the opposite direction to the above is utilized for the fine adjustment.

Figure 10A:
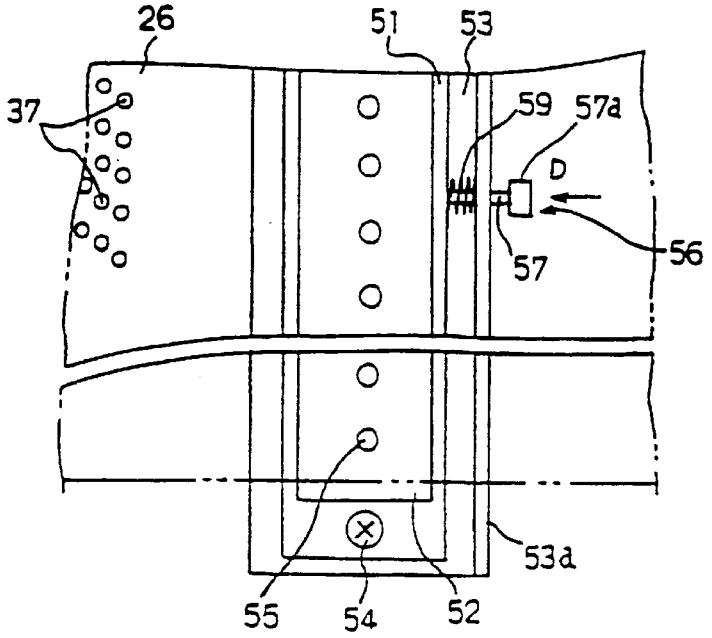
FIGS. 10A to 10B are top plan views of yet other exemplary arrangements of the adjustment means disposed at the supporting device according to the second embodiment of the invention.
Figure 10B:
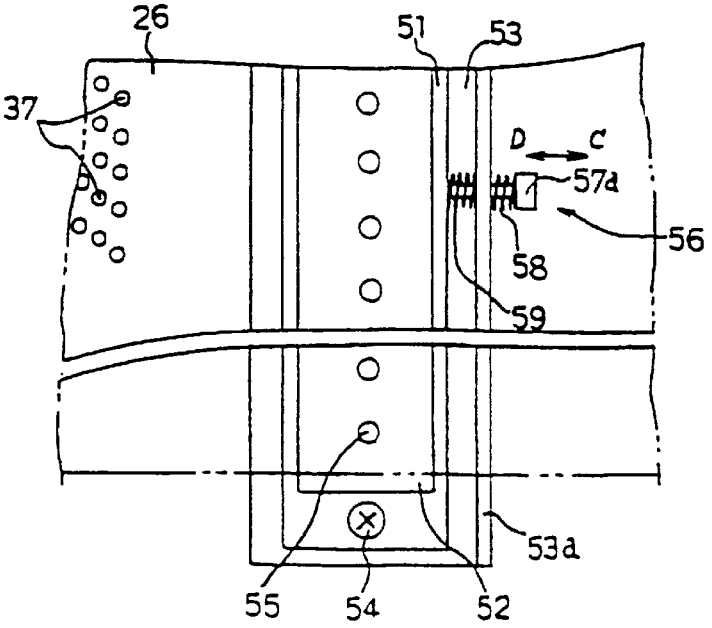

In contrast to the deformation of the control electrode member associated with the warpage and undulation in the form of a protrusion at the central portion thereof, as shown in FIG. 6, the control electrode member 26 may sometimes be shrunk at the central portion thereof depending upon a patterning configuration of the feeder lines 39 and the ring electrodes 36 so that a warpage and undulation is produced in the production of the control electrode member 26. In this case, as shown in FIG. 10A, an urging member 59 of the adjustment means 56 is interposed between the supporting member 51 and the bent portion 53*a* of the support body 53, rather than between the bent portion 53*a* and the head 57*a* of the adjusting member 57.

The urging member 59 disposed in this manner applies the supporting member 51 with a force in a direction of arrow D in the figure. According to another embodiment shown in FIG. 10B, the urging members 58, 59 may be disposed at the respective places thereby permitting the application of force in both directions of arrows C and D. Thus, the urging member may be disposed in various ways depending upon a direction or the like of the warpage and undulation of the control electrode member 26.

Figure 11:
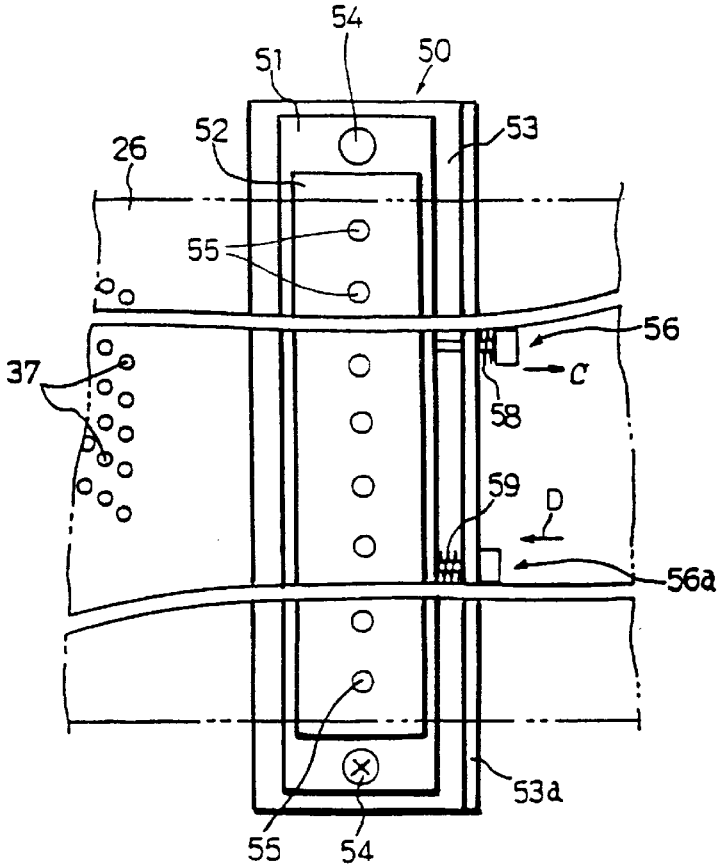
FIG. 11 is a top plan view of another exemplary arrangement of the adjustment means disposed at the supporting device according to the second embodiment of the invention.

According to the foregoing description, the adjustment means 56 is arranged such that a pair of adjusting member 57 and urging member 58 are disposed relative to the supporting member 51. However, there may be provided plural pairs of adjustment means 56 depending upon a state of the deformation associated with warpage and undulation of the control electrode member 26. FIG. 11 illustrates an example of such an arrangement.

Referring to FIG. 11, the supporting member 51 is provided with adjustment means 56, 56*a* at two places thereof. The adjustment means 56 has the construction of FIG. 1 whereas the adjustment means 56*a* has a construction shown in FIG. 7 wherein the urging member 59 is interposed between the supporting member 51 and the bent portion 53*a* of the support body 53. The provision of a plurality of adjustment means in this manner accomplishes an effective elimination of various types of local warpage and undulations existing at different places of the control electrode member.

In this case, combinations of the adjustment means 56 may be determined based on various types of warpage and undulations of the control electrode member 26. For example, the adjustment means 56 of FIG. 10A may be combined with that of FIG. 10B. Otherwise, those having the same construction or those effecting the adjustment in opposite directions to each other may be used in combination. Thus is offered a favorable prevention or reduction of warpage and undulation in a relatively complicated configuration or warpage and undulations inherent in individual control electrode members 26.

Although the warpage and undulation of the control electrode members 26 are quite commonly observed, as described in the foregoing, the configurations and dimensions thereof vary depending upon electrode pattern layouts or production methods of the control electrode members 26. It is, therefore, preferable to suitably select a quantity of adjustment or any one of the adjustment methods abovementioned according to a control electrode member to be used. In addition, even control electrode members 26 of the same design individually vary in the quantity of warpage and undulation and therefore, the control electrode members 26 may preferably be subjected to the fine adjustment by means of the adjustment means 56 abovementioned so that the control electrode members 26 may be supported in desired manners, respectively, for prevention of the degraded image quality.

Figure 12:
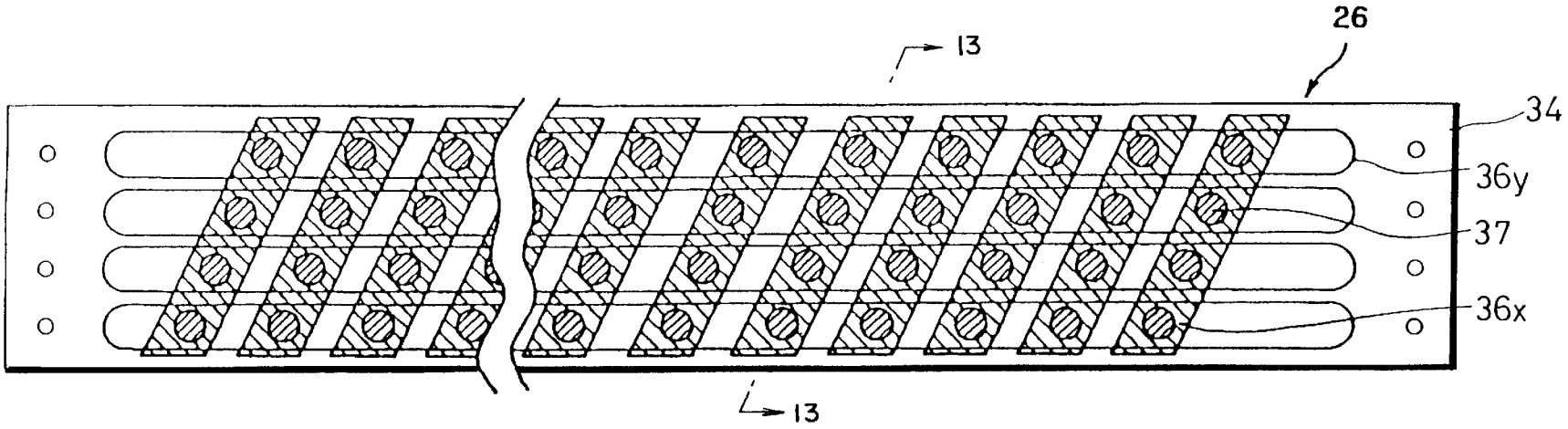
FIG. 12 is a top plan view of an exemplary arrangement of the matrix-formed control electrode of the image forming station according to the invention.
Figure 13:
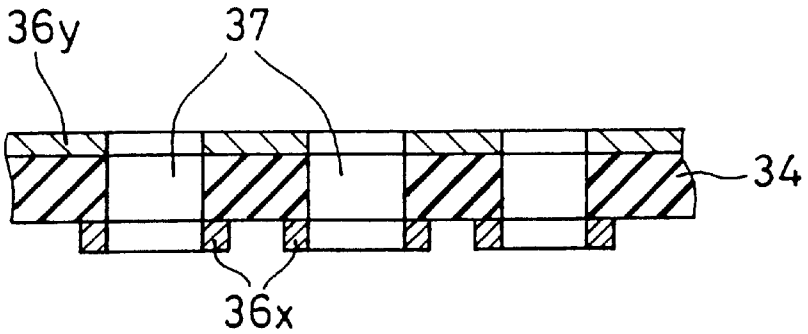
FIG. 13 is a sectional view taken on line XIII—XIII in FIG. 12.

According to the foregoing description of the embodiments of the invention, the control electrode member 26 is constructed such that the gates 37 are two-dimensionally arranged and the ring electrodes 36 correspond to the respective gates 37. Alternatively, as shown in FIG. 12, the control electrode member 26 may have a matrix arrangement wherein band-like row-electrodes 36*x* and line-electrodes 36*y* are formed on the opposite surfaces of an electrically insulative substrate 34 as squarely intersecting with each other while the gates 37 are formed at respective intersections. FIG. 13 is a sectional view of the control electrode member 26 taken on line XIII—XIII in FIG. 12.

For example, control is provided such that either ON or OFF potential is applied to the row-electrodes 36*x* based on an image signal, while ON potential is periodically applied to the individual line-electrodes 36*y*. This permits the toner to be projected from the toner carrier 22 to the copy sheet 4 through the gates 37 corresponding to the electrodes 36*x* and 36*y* supplied with the ON potential and thus, an image is formed on the copy sheet.

The control electrode member 26 of this construction may also be supported by the supporting devices 50 of FIG. 1 at the opposite end portions thereof for elimination of the warpage and undulation produced in the region of the gates 37 thereby ensuring a stable projection of the toner. Thus is prevented the degradation of image quality.

The control electrode of the construction shown in FIG. 12 accomplishes a notable reduction of the number of switching means composing the high-voltage driver which switches potentials for controlling the toner-projection through the respective gates 37. For example, the number of FETs (high voltage transistors and the like) composing the switching means is reduced to about ¼ of those of the control electrode 26 of the construction shown in FIG. 5.

Color Image Forming Apparatus

The foregoing embodiments are described by way of the example of a monochrome image forming apparatus but should not be limited to this image forming apparatus. Each of the foregoing embodiments is applicable to color image forming apparatuses for obtaining an equivalent effect. Especially, the embodiments of the invention provides favorable color reproduction for a color image, thus faithfully reproducing an image of halftone or free from unwanted color tone variation.

Figure 14:
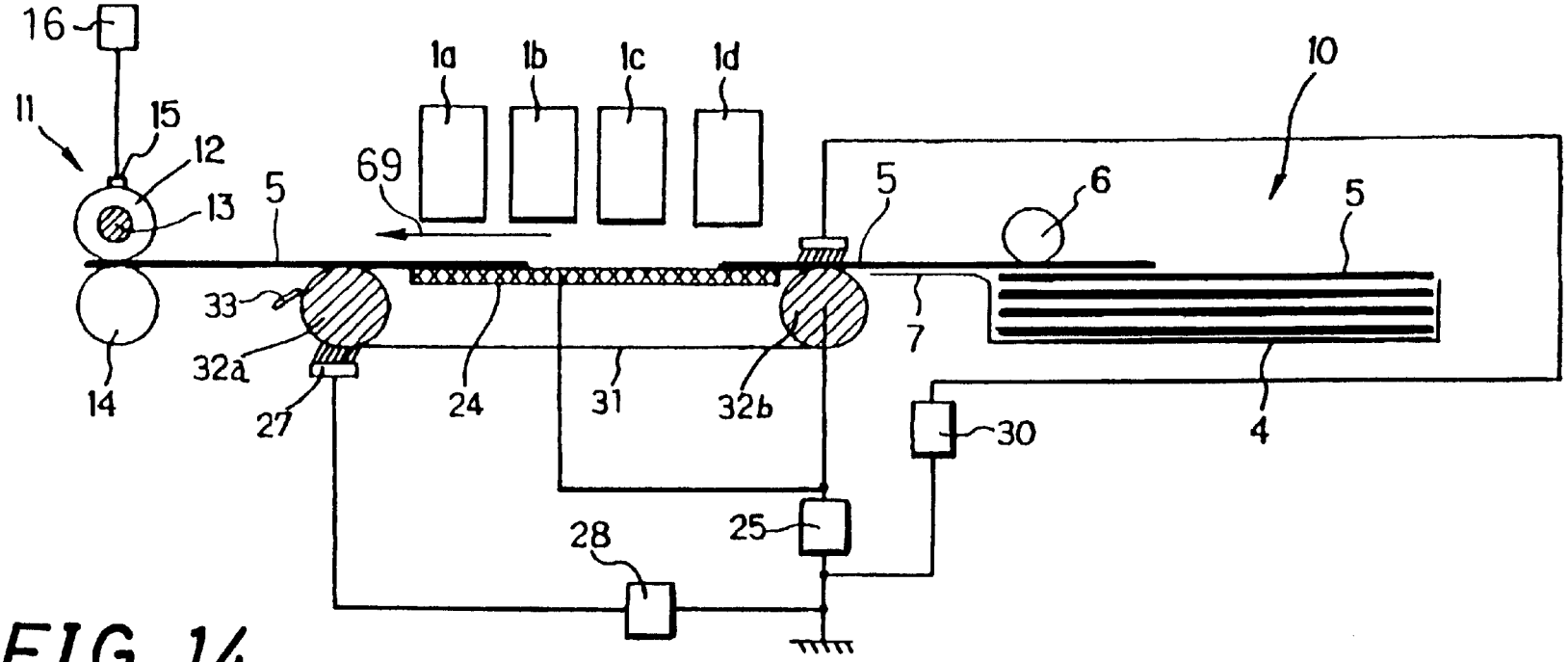
FIG. 14 is a schematic diagram illustrating an exemplary construction of an image forming station of a color image forming apparatus.

As shown in FIG. 14, the color image forming apparatus includes a plurality of image forming stations 1*a*–1*d* respectively having a toner feeding section and a printing section. The respective toner feeding sections of the image forming stations 1*a*–1*d* contain toners of different colors such as yellow, magenta, cyan and black.

While a copy sheet 4, as attracted to the dielectric belt 31, is transported through a development region where the image forming stations and the counter electrodes 24 are disposed in opposed relation, particle-projecting potentials corresponding to image data of the respective colors are applied to the respective control electrode members 26 of the construction shown in FIG. 6 or 12 and thus, a color image is formed with toner of the different colors.

The color image forming apparatus of FIG. 14 utilizes plural types of toner 21, each of which may have properties different from one another. Accordingly, it is reasonable to control the respective image forming stations in a manner to effect desired toner-projections of the respective toner 21. An arrangement wherein all the image forming stations 1*a*–1*d* employ the control electrode members 26 of the same construction is not suitable for this control method. Accordingly a plurality of image forming stations each employ the control electrode member 26 of different configuration. For example, the image forming station 1*d* employs a control electrode member 26 having ring electrodes 36 with apertures 200 $\mu$m in diameter whereas another image forming station 1*b* employs a control electrode member 26 having ring electrodes 36 with apertures 220 $\mu$m in diameter, another image forming station 1*c* employs a control electrode member 26 having ring electrodes 36 with apertures 190 $\mu$m in diameter, and such.

Alternatively, the image forming stations may employ control electrode members 26 different from one another in the electrode patterns themselves. It is not unreasonable that the control electrode members 26 for the respective colors have different deformations associated with their respective warpage and undulations because the control electrode members are required to adequately exhibit the properties of the respective toner 21 used by the image forming stations. Hence, the control electrode members 26 of the image forming stations 1*a*–1*d* may respectively be provided with the supporting devices 50 including the adjustment means 56 each of which suitably adopts any one of the various adjusting methods for favorable supporting of the control electrode member 26. Furthermore, the adjustment means 56 may be arranged such that any one of the various constructions is employed while permitting a different fine adjustment to each control electrode member 26.

Such arrangements prevent the properties of the toner 21 of different colors from being impaired thereby accomplishing the forming of favorable images.

In the embodiments of the invention described with reference to FIG. 1, the supporting devices 50 of the identical construction are provided at the opposite end portions of the control electrode member 26. However, by at least providing the supporting device 50 of the invention at one end of the control electrode member 26, the warpage and undulation produced in the control electrode member 26 can be reduced or eliminated. Furthermore, a sufficient effect of reducing or eliminating the warpage and undulation can be attained by attaching the adjustment means 56 to at least one of the supporting devices 50. That is, while the adjustment means 56 is provided at the supporting device 50 on the right side as seen in FIG. 1, the supporting device 50 on the left side in the figure does not require the adjustment means 56. It is to be noted that in a case where the control electrode member is provided with the supporting devices at the opposite end portions thereof, the positions of the adjustment means 56 need not correspond each other but may suitably be varied depending upon a state of the warpage and undulation.

Although the embodiments of the invention are described by way of the example using the colored toner material as the developer, it is to be understood that the invention is not limited to the toner material and other developers such as ink may be used. In this case, as well, any of the foregoing embodiments of the invention may be applied as they are. Further, the toner feeding section 31 may have a construction utilizing the ion flow method. That is, the image forming station 1 may be constructed to include an ion source embodied by a corona charger or the like. In this case, as well, a like control electrode member 26 and counter electrode are provided for controlling the passage of ions.

The image forming apparatuses of the invention is applicable to digital copiers, printing stations of facsimiles, digital printers, plotters and the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a carrier for carrying thereon a developer charged at a predetermined polarity;

a counter electrode disposed to be opposed to the carrier; and a flat-shaped control electrode member interposed between the carrier and the counter electrode, having a plurality of gates for passage of the developer and control electrodes for controlling selective passage of the developer by means of the respective gates thereof, the image forming apparatus recording with the developer a desired image on a recording medium, which is transported in a transporting direction through a gap between the control electrode and the counter electrode, by supplying a developer-passage potential to the control electrodes based on image data and thereby selectively permitting the developer to pass through the gates, wherein said control electrode member has a pair of support regions that are spaced apart from a central region having the plurality of gates, one supporting region on each side of said central region in the transporting direction, the image forming apparatus further comprising a support body and a support device for supporting said control electrode to the support body at a predetermined position, wherein the support device comprises (1) a first support member having a first flat surface and a first fixing member that holds one support region of the control electrode member fixedly on said first flat surface and (2) a second support member having a second flat surface and a second fixing member that holds the other support region of the control electrode member fixedly on said second flat surface, wherein the supporting members are fixed to the support body in a state in which forces are applied on the support regions to push the support regions closer to each other so as to resiliently curve the control electrode member at the central region including the gates.

2. The image forming apparatus of claim 1, wherein the first fixing member has a flat portion and the supporting device has a structure in which one support region of the control electrode member is fixed by holding the support region between the first flat surface of the first supporting member and the flat portion of the fixing member.

3. The image forming apparatus of claim 1 or 2, wherein the first supporting member is fixed to the support body at at least two points spaced from each other along a direction transverse to the transporting direction, and said apparatus further comprises adjustment means for slightly deforming the supporting member in the transporting direction, the adjustment means being provided at a position of the first supporting member other than at the fixing points.

4. The image forming apparatus of claim 3, wherein the carrier has an outer circumferential surface shaped like an arc about an axis perpendicular to the transporting direction, and protrudes toward the control electrode member, and the control electrode member is curved to protrude toward the counter electrode.

5. The image forming apparatus of any one of claims 1 or 2, wherein the carrier has an outer circumferential surface shaped like an arc about an axis perpendicular to the transporting direction, and protrudes toward the control electrode member, and the control electrode member is curved to protrude toward the counter electrode.

6. The image forming apparatus of claim 3, wherein the adjustment means includes a resilient urging member for applying a spring-urging force to the first supporting member in the transporting direction thereby slightly deforming the first supporting member.

7. The image forming apparatus of claim 6, wherein the resilient urging member utilizes a portion of the support body to provide a force to slightly deform the first supporting member.

8. The image forming apparatus of claim 7, wherein the carrier has an outer circumferential surface shaped like an arc about an axis perpendicular to the transporting direction, and protrudes toward the control electrode member, and the control electrode member is curved to protrude toward the counter electrode.

9. The image forming apparatus of claim 6, wherein the carrier has an outer circumferential surface shaped like an arc about an axis perpendicular to the transporting direction, and protrudes toward the control electrode member, and the control electrode member is curved to protrude toward the counter electrode.

10. An image forming apparatus comprising:

a carrier for carrying thereon a developer charged at a predetermined polarity;

a counter electrode disposed to be opposed to the carrier; and a flat-shaped control electrode member interposed between the carrier and the counter electrode, having a plurality of gates for passage of the developer and control electrodes for controlling selective passage of the developer by means of the respective gates thereof, the image forming apparatus recording with the developer a desired image on a recording medium, which is transported in a transporting direction through a gap between the control electrode and the counter electrode, by supplying a developer-passage potential to the control electrodes based on image data and thereby selectively permitting the developer to pass through the gates, wherein said control electrode member has a pair of support regions that are spaced apart from a central region having the plurality of gates, one supporting region on each side of said central region in the transporting direction, the image forming apparatus further comprising a support body and a support device for supporting said control electrode to the support body at a predetermined position, wherein the support device comprises (1) a first support member having a first flat surface and a first fixing member that holds one support region of the control electrode member fixedly on said first flat surface and (2) a second support member having a second flat surface and a second fixing member that holds the other support region of the control electrode member fixedly on said second flat surface, said apparatus further comprising adjustment means for slightly deforming the supporting member in the transporting direction, the adjustment means being provided at a position of the first supporting member other than at the fixing points.

11. An image forming apparatus comprising:

a carrier for carrying thereon a developer charged at a predetermined polarity;

a counter electrode disposed to be opposed to the carrier; and a flat-shaped control electrode member interposed between the carrier and the counter electrode, having a plurality of gates for passage of the developer and control electrodes for controlling selective passage of the developer by means of the respective gates thereof, the image forming apparatus recording with the developer a desired image on a recording medium, which is transported in a transporting direction through a gap between the control electrode and the counter electrode, by supplying a developer-passage potential to the control electrodes based on image data and thereby selectively permitting the developer to pass through the gates, wherein said control electrode member has a pair of support regions that are spaced apart from a central region having the plurality of gates, one supporting region on each side of said central region in the transporting direction, the image forming apparatus further comprising a support body and a support device for supporting said control electrode to the support body at a predetermined position, wherein the support device comprises supporting members that are fixed to the support body in a state in which forces are applied on the support regions to push the support regions closer to each other so as to resiliently curve the control electrode member at the central region including the gates wherein the carrier has an outer circumferential surface shaped like an arc about an axis perpendicular to the transporting direction, and protrudes toward the control electrode member, and the control electrode member is curved to protrude toward the counter.

* * * * *